US012018352B2

(12) United States Patent
Sakakibara et al.

(10) Patent No.: US 12,018,352 B2
(45) Date of Patent: Jun. 25, 2024

(54) HOT ROLLED STEEL SHEET

(71) Applicant: NIPPON STEEL CORPORATION, Tokyo (JP)

(72) Inventors: Mutsumi Sakakibara, Tokyo (JP); Akifumi Sakakibara, Tokyo (JP); Tetsu Asato, Tokyo (JP); Akihiro Yamamoto, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 233 days.

(21) Appl. No.: 17/623,563

(22) PCT Filed: Jun. 15, 2020

(86) PCT No.: PCT/JP2020/023339
§ 371 (c)(1),
(2) Date: Dec. 28, 2021

(87) PCT Pub. No.: WO2021/005971
PCT Pub. Date: Jan. 14, 2021

(65) Prior Publication Data

US 2022/0251693 A1 Aug. 11, 2022

(30) Foreign Application Priority Data

Jul. 10, 2019 (JP) ..... 2019-128611

(51) Int. Cl.
*C22C 38/00* (2006.01)
*C21D 6/00* (2006.01)
(Continued)

(52) U.S. Cl.
CPC ..... *C22C 38/54* (2013.01); *C21D 6/004* (2013.01); *C21D 6/005* (2013.01); *C21D 6/008* (2013.01);
(Continued)

(58) Field of Classification Search
CPC ..... C22C 38/50; C22C 38/48; C22C 38/46; C22C 38/44; C22C 38/42; C22C 38/54;
(Continued)

(56) References Cited

U.S. PATENT DOCUMENTS

2010/0040872 A1* 2/2010 Murakami ..... C22C 38/04 148/648

FOREIGN PATENT DOCUMENTS

CN 108061536 A * 5/2018 ..... G01B 21/08
CN 108291282 A 7/2018
(Continued)

OTHER PUBLICATIONS

Hannoki et al., JP-3704876-B2 Google Patents Machine Translation printed on Oct. 12, 2023, Oct. 12, 2005, entire translation (Year: 2005).*

(Continued)

*Primary Examiner* — Katherine A Christy
(74) *Attorney, Agent, or Firm* — Birch, Stewart, Kolasch & Birch, LLP

(57) ABSTRACT

This hot rolled steel sheet is a hot rolled steel sheet including a base steel sheet and a scale formed on a surface of the base steel sheet, in which the base steel sheet has a predetermined chemical composition, the scale has a layer structure composed of wustite, magnetite, and hematite in order from the base steel sheet side or a layer structure composed of the wustite and the magnetite in order from the base steel sheet side, and, when a thickness of the scale is represented by s, a thickness of the hematite is represented by h, and a thickness of the magnetite is represented by m, the s, the h, and the m satisfy formula (1) and formula (2).

$(h+m)/s<0.20$ Formula (1)

$h\leq m/4$ Formula (2)

6 Claims, 1 Drawing Sheet

(51) Int. Cl.

| | |
|---|---|
| ***C21D 8/02*** | (2006.01) |
| ***C21D 9/46*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/54*** | (2006.01) |

(52) U.S. Cl.
CPC ..... *C21D 8/0205* (2013.01); *C21D 8/0226* (2013.01); *C21D 9/46* (2013.01); *C22C 38/001* (2013.01); *C22C 38/004* (2013.01); *C22C 38/005* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01)

(58) Field of Classification Search
CPC ... C22C 38/001; C22C 38/004; C22C 38/005; C22C 38/02; C22C 38/04; C22C 38/06
USPC ..... 428/469
See application file for complete search history.

(56) References Cited

FOREIGN PATENT DOCUMENTS

| | | | | |
|---|---|---|---|---|
| JP | 2000-87185 | A | | 3/2000 |
| JP | 3704876 | B2 | * | 10/2005 |
| JP | 4987786 | B2 | | 7/2012 |
| JP | 5799913 | B2 | | 10/2015 |

OTHER PUBLICATIONS

Huo et al., CN108061536A Google Patents Machine Translation printed on Oct. 12, 2023, May 22, 2018, entire translation (Year: 2018).*

Kobayashi et al., "Peeling Propeties and Structures of Scale in Steel Sheet", CAMP-ISIJ, vol. 11, 1998, pp. 1087-1090, total of 10 pages.

* cited by examiner

HOT ROLLED STEEL SHEET

TECHNICAL FIELD OF THE INVENTION

The present invention relates to a hot rolled steel sheet.

Priority is claimed on Japanese Patent Application No. 2019-128611, filed in Japan on Jul. 10, 2019, the content of which is incorporated herein by reference.

RELATED ART

So-called hot-rolled steel sheets manufactured by hot rolling are in wide use as a relatively inexpensive structural material and as a material for structural members for automobiles and industrial equipment. Since a hot rolled steel sheet passes through an oxidative atmosphere during hot rolling, scale (iron oxide) is inevitably formed on the surface of the steel sheet. In some cases, this scale exfoliates from the base metal of the steel sheet at the time of passing through a variety of rolls during hot rolling, during coiling, or in a subsequent finishing step. When the scale exfoliates in, the manufacturing step of the hot rolled steel sheet as described above or the scale exfoliates at the time of processing the hot rolled steel sheet into a variety of vehicle components and construction components while remaining unexfoliated at a point in time after the manufacturing of the hot rolled steel sheet, there is a possibility that this exfoliation may bring about not only the deterioration of good appearance but also the deterioration of corrosion resistance in the operation environments of the hot rolled steel sheet as a product, which is not preferable. In addition, when the scale partially exfoliates in the finishing step, there are cases where the scale remaining on the surface is pressed into the surface of the steel sheet when the hot rolled steel sheet passes through rolls, and an uneven pattern remains even after pickling. In this case, the good appearance disappears, and there are cases where the surface unevenness causes the deterioration of fatigue properties or the like. For this reason, hot rolled steel sheets are required to be excellent in terms, of the adhesion between the scale and the base metal.

It is known that the adhesion between the base metal and the scale becomes favorable by thinning the scale. This is considered to be because strain that is applied to the surface layer of the scale during the coiling of the hot rolled steel sheet, during uncoiling in the finishing step, or during processing becomes small, and the occurrence of cracks is suppressed. In addition, it is known that the adhesion between the base metal and the scale becomes favorable in a case where magnetite ($Fe_3O_4$) is formed in the interface between wustite (FeO) and the base metal. The reason therefor is not clear, but is assumed that a magnetite layer formed from the interface between the base metal and wustite has favorable consistency with, the base metal. In addition, it is known that, when an element that easily undergoes grain-boundary oxidation such as Cu, Ni, or Si is contained in the interface with the base metal, the adhesion between the base metal and the scale improves due to an anchoring effect.

In the related art, hot rolled steel sheets and manufacturing methods therefor that are based on the above-described knowledge, have been proposed. For example, Patent Document 1 discloses a method in which the cooling rate after finish rolling and the coiling temperature are controlled to set a scale thickness to 20 μm or less and the fraction of the length in the rolling direction of the interface where the base metal and magnetite come into contact with each other to 80% or more, thereby enhancing the scale adhesion. In addition, Patent Document 2 discloses a method in which, the coiling temperature is set to 600° C. or lower to make magnetite account for 80% or more of scale and, additionally, Cu or Ni is added to obtain an anchoring effect, thereby enhancing the scale adhesion. Furthermore, Patent Document 3 discloses a technique in which, in a finish rolling step, cooling water or nitrogen gas is sprayed between individual rolling stands, and the oxygen concentration on the surface of a steel sheet is controlled, thereby suppressing the growth of scale and manufacturing a hot rolled steel sheet having excellent surface properties in which no scale blisters occur.

However, the disclosed techniques of Patent Documents 1 and 2 are methods for enhancing the scale adhesion by controlling the cooling rate after finish rolling and the coiling temperature, and, in the case of adopting such methods, the microstructure control of the steel sheet is limited. In addition, there is no description regarding a method for improving the scale adhesion in the case of setting the coiling temperature to 300° C. or lower.

Furthermore, the enhancement of the scale adhesion by adding an alloy of Cu, Ni, or the like, which is an element that enhances the scale adhesion as in Patent Document 2, leads to an increase in costs.

Patent Document 3 is a technique for improving surface properties by con offing the oxygen concentration during finish, rolling. However, according to the present inventors' knowledge, in the technique of Patent Document 3, even in a case where the scale does not exfoliate at a point in time after the manufacturing of a hot rolled steel sheet, there are cases where the scale adhesion is not sufficient at the time of processing the hot rolled steel sheet into a variety of components and the scale exfoliates.

PRIOR ART DOCUMENT

Patent Document

[Patent Document 1] Japanese Patent No, 5799913
[Patent Document 2] Japanese Unexamined Patent Application, First Publication No. 2000-87185
[Patent Document 3] Japanese Patent No. 4987786

DISCLOSURE OF THE INVENTION

Problems to be Solved by the Invention

In view of the above-described studies, an object of the present invention is to provide a hot rolled steel sheet having excellent surface properties (external appearance) and excellent scale adhesion. In particular, the object is to provide a hot rolled steel sheet in which the amounts of Cu, Cr, and Ni, which are elements that enhance scale adhesion, are reduced as much as possible.

Means for Solving the Problem

The present inventors paid attention to the constitution of layers that constitute scale and performed an intensive investigation on scale adhesion. As a result, it was clarified that, even in a case where an alloy that exhibits an anchoring effect is not added, when scale has a layer structure composed of wustite, magnetite, and optional hematite in order from the base steel sheet side (that is, a layer structure composed of wustite, magnetite, and hematite in order from the base steel sheet side or a layer structure composed of the wustite and the magnetite in order from the base, steel sheet side), and the thickness of hematite, and magnetite, which are brittle layers in the surface layer of the scale, is below a certain fraction in the total thickness of the scale, the scale adhesion is enhanced.

In addition, the present inventors also found that it is effective to control the conditions for hot rolling to coiling in order to obtain the above-described scale layer structure. Particularly, it was clarified that the thickness fractions of hematite, magnetite, and wustite that are included in the scale layer structure are significantly affected by the scale growth rate and the oxygen concentration during hot rolling, and, in order to decrease the thickness fraction of hematite and magnetite, it is important to stretch a water film on the surface of the steel sheet under predetermined conditions during the hot rolling and to cover the surface of the steel sheet with the water film.

The present invention has been made in view of the above-described findings. The gist of the present invention is, as described below.

[1] A hot rolled steel sheet according to one aspect of the present invention is a hot rolled steel sheet including a base steel sheet and a scale formed on a surface of the base steel sheet, in which a chemical composition of the base steel sheet contains, by mass %, C: 0.010% to 0.200%, Si: 0% to 0.30%, Mn: 0.10% to 3.00%, Al: 0.010% to 3.000%, P: 0.100% or less, S: 0.030% or less. N: 0.0100% or less, O: 0.0100% or less, Cu: 0% to 0.10%, Cr: 0% to 0.10%. Ni: 0% to 0.10%, Ti: 0% to 0.30%, Nb: 0% to 0.300%, Mg: 0% to 0.0100%, Ca: 0% to 0.0100%, REM: 0% to 0.1000%, B: 0% to 0.0100%, Mo: 0% to 1.00%, V: 0% to 0.50%, W: 0% to 0.50%, and a remainder: Fe and impurities, a total of a Cu content, a Cr content, and a Ni content of the base steel sheet is 0.10% or less by mass %, the scale has a layer structure composed of wustite, magnetite, and hematite in order from the base steel sheet side or a layer structure composed of the wustite and the magnetite in order from the base steel sheet side, and, when a thickness of the scale is represented by s, a thickness of the hematite is represented by h, and a thickness of the magnetite is represented by m, the s, the h, and them satisfy formula (1) and formula (2).

$$(h+m)/s<0.20 \quad \text{Formula (1)}$$

$$h\leq m/4 \quad \text{Formula (2)}$$

[2] The hot rolled steel sheet according to [1], in which the thickness of the scale may be 35.0 μm or less.

[3] The hot rolled steel sheet according to [1] or [2], in which the thickness of the scale may be 30.0 μm or less.

[4] The hot rolled steel sheet according to any one of [1] to [3], in which a thickness of the hot rolled steel sheet may be 1.0 mm to 6.0 mm.

[5] The hot rolled steel sheet according to any one of [1] to [4], in which the chemical composition of the base steel sheet may contain, by mass %, one or more selected from the group consisting of Ti: 0.01% to 030%, Nb: 0.010% to 0.300%, Mg: 0.0003% to 0.0100%, Ca: 0.0003% to 0.0100%, REM: 0.0003% to 0.1000%, B: 0.0005% to 0.0100%, Mo: 0.005% to 1.00%, V: 0.005% to 0.50%, and W: 0.005% to 0.50%.

Effects of the Invention

According to the above-described aspect of the present invention, it is possible to provide a hot rolled steel sheet having excellent surface properties and excellent scale adhesion. Since the scale adhesion is excellent and thus scale exfoliation is suppressed during hot rolling, during coiling, or in a finishing step, the hot rolled steel sheet according to the above-described aspect of the present invention is excellent in terms of the surface properties (surface external appearance) as hot rolled steel sheets. In addition, since the scale adhesion is excellent and thus it is also possible to suppress the exfoliation of the scale at the time of processing this hot rolled steel sheet into components or the like, the hot rolled steel sheet is also excellent in terms of the external appearance after processing.

EMBODIMENTS OF THE INVENTION

Hereinafter, a hot rolled steel sheet according to an embodiment of the present invention (the steel sheet according to the present embodiment) will be described in detail. Here, the present invention is not limited only to a constitution disclosed in the present embodiment and can be modified in a variety of manners within the scope of the gist of the present invention. In addition, numerical limiting ranges described below using "to" include values at both ends in the ranges as the lower limit value and the upper limit value. However, numerical values expressed with 'more than' or 'less than' are, not included in numerical ranges. "%" regarding the amount of each element means "mass %".

Figure 1A:
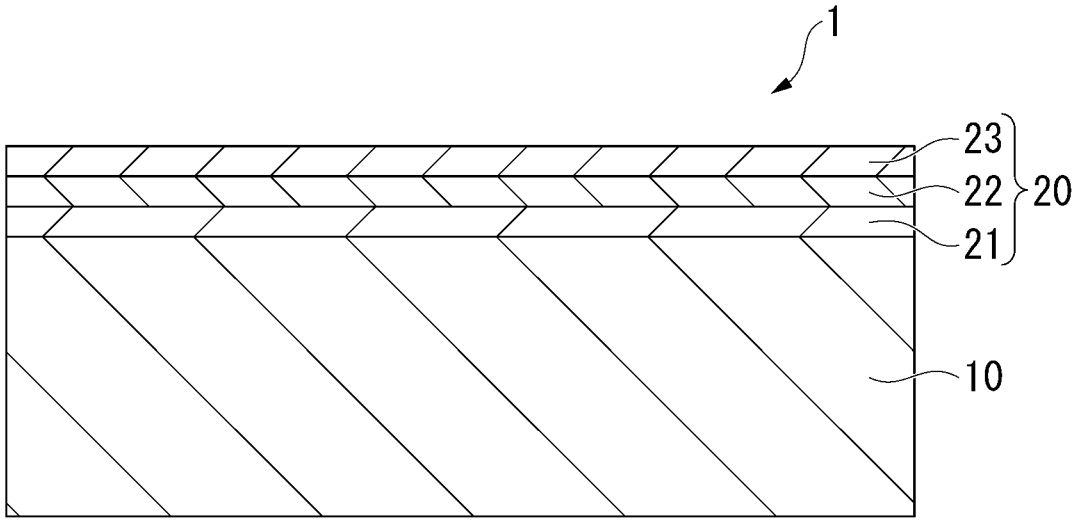
FIG. 1A is a schematic view of an example of a cross section, of a steel sheet according to the present embodiment.
Figure 1B:
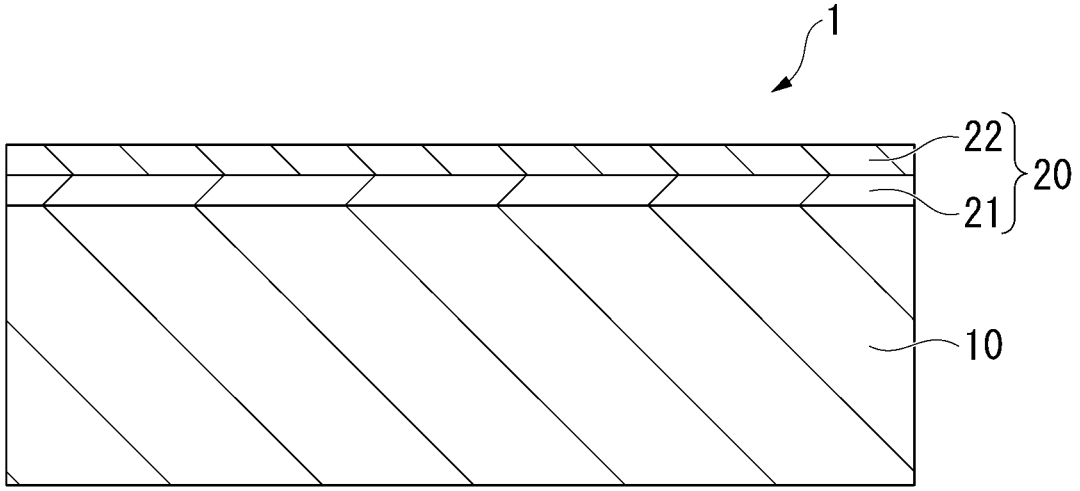
FIG. 1B is a schematic view of an example of the cross section of the steel sheet according to the present embodiment.

As shown in FIG. 1A and FIG. 1B, a steel sheet 1 according, to the present embodiment includes a base steel sheet 10 having a predetermined chemical composition and a scale 20 formed on a surface of the base steel sheet.

The scale 20 has a layer structure composed of wustite 21, magnetite 22, and hematite 23 in order from the base steel sheet side or a layer structure composed of the wustite 21 and the magnetite 22 in order from the base steel sheet side.

When the thickness of the scale 20 is represented by s, the thickness of the hematite 23 is represented by h, and the thickness of the magnetite 22 is represented by m, s, h, and m satisfy the following formula (1) and formula (2).

$$(h+m)/s<0.20 \quad \text{Formula (1)}$$

$$h\leq m/4 \quad \text{Formula (2)}$$

1. Base Steel Sheet

<Chemical Composition>

Hereinafter, the chemical composition of the base steel, sheet 10 of the steel sheet (hot rolled steel sheet) 1 according to the present embodiment will be described in detail. The base steel sheet 10 of the steel sheet 1 according to the present embodiment contains, as chemical components, basic elements, a selective element as necessary, and the remainder includes Fe and impurities.

Among the chemical components of the base steel sheet of the steel sheet according to the present embodiment, C, Si, Mn, and Al are the basic elements (major alloying elements).

(C: 0.010% to 0.200%)

C is an element necessary to ensure the strength of the steel sheet. When the C content is less than 0.010%, the above-described effect cannot be sufficiently obtained. Therefore, the C content is set to 0.010% or more. The C content is preferably 0.020% or more.

On the other hand, when the C content becomes more than 0.200%, the weldability becomes poor. Therefore, the C content is set to 0.200% or less.

(Si: 0% to 0.30%)

Si is a deoxidizing element. In addition, Si significantly forms a tiger stripe-like Si scale pattern on the surface of the steel sheet and significantly degrades the surface properties. Therefore. Si is an element that extremely degrades the productivity of a scale removal step (pickling or the like) in a finishing line. When the Si content is more than 0.30%, the surface properties significantly deteriorate, and the productivity of a pickling step extremely deteriorates. Therefore, the Si content is set to 0.30% or less. Even when Si is not contained, the intended effect of the steel sheet according to the present embodiment can be obtained. Therefore, the lower limit of the Si content is not particularly determined, and the Si content may be 0%. However, the Si content set to less than 0.001% leads to an increase in the steelmaking cost, which is not preferable. Therefore, the Si content may be set to 0.001% or more. In addition the Si content may be set to 0.01% or more.

(Mn: 0.10% to 3.00%)

Mn is an element that contributes to an increase in the strength of the steel sheet. In order to ensure the strength of the steel sheet, the Mn content is set to 0.10% or more.

On the other hand, when a large amount of Mn is contained, the toughness deteriorates. In addition, the steelmaking cost also increases at the same time. Therefore, the Mn content is set to 3.00% or less.

(Al: 0.010% to 3.000%)

Al is an element having an action of deoxidizing steel to make the steel sheet integrity. When the Al content is less than 0.010%, deoxidization is not sufficient. Therefore, the Al content is set to 0.010% or more.

On the other hand, when the Al content is more than 3.000%, the weldability significantly deteriorates, and the number of oxide-based inclusions increases, which significantly degrades the surface properties. Therefore, the Al content is set to 3.000% or less. The Al content is preferably 1.500% or less, more preferably 1.000% or less, still more preferably 0,750% or less, and most preferably 0.080% or less.

The steel sheet according to the present embodiment contains Fe and impurities as the remainder of the chemical composition. "Impurities" refer to elements that are mixed from ore or scrap that is a raw material or from manufacturing environments or the like at the time of industrially manufacturing steel. Examples of the impurities include P, S, N, O, and the like. Among these impurities, P, S, N, and O are preferably limited as described below in order to sufficiently exhibit the effect of the present embodiment. In addition, since the amount of impurities is preferably small, it is not necessary to limit the lower limit value, and the lower limit values of these impurities may be 0%.

(P: 0.100% or less)

P is usually an impurity that is contained in steel. P is an impurity that is contained in molten pig iron and is an element that is segregated in grain boundaries and degrades workability, weldability, and low temperature toughness as the content increases. Therefore, the P content is preferably as low as possible. When the P content becomes more than 0.100%, the adverse effect on workability, weldability, and low temperature toughness becomes large. Therefore, the P content is set to 0.100% or less. Particularly, when weldability is taken into account, the P content is preferably 0.030% or less. From the viewpoint of the dephosphorization cost, the P content may be set to 0.001% or more.

(S: 0.030% or less)

S is an impurity that is contained in steel and is an element that degrades the weldability or low temperature toughness of steel. Therefore, the S content is preferably as low as possible. When the S content is more than 0.030%, weldability significantly deteriorates, the amount of MnS precipitated increases, and low temperature toughness significantly deteriorates. Therefore, the S content is limited to 0.030% or less. The S content is preferably limited to 0.020% or less, more preferably limited to 0.010% or less, and still more preferably limited to 0.005% or less. From the viewpoint of the desulfurization cost, the S content may be set to 0.001% or more.

(N: 0.0100% or less)

N is an impurity that is contained in steel, and the content thereof is preferably as low as possible from the viewpoint of weldability. When the N content is more than 0.0100%, weldability significantly deteriorates, and thus the N content is limited to 0.0100% or less. The N content is preferably limited to 0.0050% or less. Since it is not easy to reduce the N content to less than 0.0001%, the N content may be set to 0.0001% or more.

(O: 0.0100% or less)

O is an impurity that is contained in steel and is an element that forms an oxide in steel and degrades formability. Therefore, the content thereof is preferably as low as possible. When the O content is more than 0.0100%, formability significantly deteriorates. Therefore, the O content is limited to 0.0100% or less. The O content is preferably limited to 0.0050% or less. It is not easy to reduce the O content to less than 0.0001%, and the O content may be set to 0.0001% or more.

The steel sheet according to the present embodiment may contain a selective element in addition to the basic elements and the impurities described above. For example, instead of some of Fe that is the remainder described above, one or more of Cu, Cr, Ni, Ti, Nb, B, V, Mo, Ca, Mg, REM, and W may be contained as the selective element. These selective elements may be contained according to the purpose, Therefore, it is not necessary to limit the lower limit value of these selective elements, and the lower limit value may be 0%. In addition, even when these selective elements are contained as impurities, the above-described effects are not impaired.

(Cu: 0% to 0.10%)

(Cr: 0% to 0.10%)

(Ni: 0% to 0.10%)

(Cu+Cr+Ni: 0% to 0.10%)

Cu, Cr, and Ni are all effective elements for stably ensuring the strength of steel as solid solution strengthening elements and are elements that improve the adhesion of scale. Therefore, these elements may be contained. However, in the steel sheet according to, the present embodiment, the effect of improving the scale adhesion by these elements is not essential, and the surface properties, and the scale adhesion are improved by controlling the constitution of the layers that constitute the scale. Therefore, in the steel sheet according to the present embodiment, it is not essential to contain Cu Cr, and Ni. Since these elements are expensive elements, in the steel sheet according to the present embodiment, the contents of these elements are each set to 0.10% or less. The Cu content may be set to 0.08% or less, 0.06% or less, 0.04% or less, or 0.02% or less as necessary. The Cr content may be set to 0.08% or less, 0.06% or less 0.04% c r less, or 0.02% or less. The Ni content may be set to 0.08% or less, 0.06% or less, 0.04% or less, or 0.02% or less.

Particularly, the total of the Cu content, the Cr content, and the Ni content is set to 0.10% or less. The total of the Cu content, the Cr content, and the Ni content may be set to 0.08% or less, 0.06% or less, 0.04% or less, or 0.02% or less.

(Ti: 0% to 0.30%)

Ti is an element that is precipitated as a carbonitride in steel and increases the strength. In addition, Ti is an element that refines grains in the microstructure of steel, thereby improving each of strength, toughness, and the toughness of a welded heat affected zone during welding. Therefore, Ti may be contained. When the Ti content is less than 0.01%, the above-described effect cannot be sufficiently obtained. Therefore, in a case where Ti is contained as necessary, the Ti content is preferably set to 0.01% or more. The Ti content is more preferably 0.10% or more.

On the other hand, even when the Ti content exceeds 0.30%, the above-described effect is saturated, and thus the economic efficiency deteriorates. Therefore, even in a case there Ti is contained, the Ti content is set to 0.30% or less.

(Nb: 0% to 0.300%)

Nb is, similar to Ti, an element that is precipitated as a carbonitride in steel and increases the strength and refines grains in the microstructure of steel, thereby improving each of strength, toughness, and the toughness of a welded heat-affected zone when welding is performed. Therefore, Nb may be contained. When the Nb content is less than 0.010%, the above-described effect cannot be sufficiently obtained. Therefore, in a case where Nb is contained as necessary, the Nb content is preferably set to 0.010% or more.

On the other hand, even when the Nb content exceeds 0.300%, the above-described effect is saturated, and thus the economic efficiency deteriorates. Therefore, even in a case where Nb is contained, the Nb content is set to 0.300% or less.

(B: 0% to 0.0100%)

B is an element capable of suppressing punched cross sections being roughened at the time of punching by being segregated in grain boundaries and improving the grain boundary strengths. Therefore, B may be contained. In order to obtain the above-described effect, the B content is preferably set to 0.0005% or more.

On the other hand, even when the B content exceeds 0.0100%, the above-described effect is saturated, and such a content becomes economically disadvantageous. Therefore, even in a case where B is contained, the B content is set to 0.0100% or less. The B content is preferably 0.0050% or less and more preferably 0.0030% or less.

(V: 0% to 0.50%)

(W: 0% to 0.50%)

(Mo: 0% to 1.00%)

V, W, and Mo are all effective elements for stably ensuring the strength of steel. Therefore, these elements may be contained. In order to more reliably obtain the effect of the above-described action, at least one of V: 0.005% or more, W: 0.005% or more, and Mo: 0.005% or more is preferably contained. At least one or more of V: 0.01% or more. W: 0.01% or more, and Mo: 0.01% or more is more preferably contained.

On the other hand, even when more than 0.50% of V, more than 0.50% of W, and/or more than 1.00% of Mo are contained, the effect of the above-described action is saturated, and it is economically disadvantageous. Therefore in a case where V, W, and Mo are contained, it is preferable to set the V content to 0.50% or less, set the W content to 0.50% or less, and set the Mo content to 1.00% or less.

(Ca: 0% to 0.0100%)

(Mg: 0% to 0.0100%)

(REM: 0% to 0.1000%)

Ca, Mg, and REM are all effective elements for controlling an inclusion. Ca, Mg, and REM are elements that contribute particularly to the fine dispersion of an inclusion and have an effect of enhancing toughness. Therefore, one or two or more of these elements may be contained. In order to more reliably obtain the above-described effect, the amount of at least one of these elements is preferably set to 0.0003% or more. The amount of at least one of these elements is more preferably 0.0010% or more.

On the other hand, when 0.0100% of Ca, 0.0100% of Mg, and more than 0.1000% of REM are contained, there are cases where the deterioration of the surface properties is actualized. Therefore, even in a case where Ca, Mg, and REM are contained, it is preferable to set each of the Ca content and the Mg content to 0.0100% or less and set the REM content to 0.1000% or less. Here. REM refers to a total of 17 elements of Sc, Y, and lanthanoids. The REM content means the total amount of these elements, industrially, lanthanoids are added in a mischmetal form.

The above-described chemical composition may be measured by an ordinary analytical method for steel. For example, the chemical composition may be measured using inductively coupled plasma-atomic emission spectrometry (ICP-AES). C and S may be measured using an infrared absorption method after combustion, N may be measured using an inert gas melting-thermal conductivity method, and O may be measured using an inert gas fusion-nondispersive infrared absorption method.

<Microstructure>

The base steel sheet of the steel sheet, according to the present embodiment is capable of obtaining the effect without limiting the steel structure (microstructure). As the constituent phases of the steel, structure, any phases of ferrite, pearlite, bainite, fresh martensite, tempered martensite, pearlite, residual, austenite, and the like may be included, and a compound such as a carbonitride may also be contained in the structure.

For example, the structure includes 80% or less of ferrite and 0% to 100% of bainite or martensite in terms of the area ratio and can include 25% or less of residual austenite and 5% or less of pearlite as other structures.

2. Scale

<Having layer structure composed of wustite, magnetite, and hematite in order from steel sheet side or layer structure composed of wustite and magnetite in order from steel sheet side>

<When scale thickness is represented by s, hematite thickness is represented, by h, and magnetite thickness is represented by m, s, h, and m satisfy "$(h+m)/s<0.20$" and "$h \leq m/4$">

The present inventors paid, attention to the constitution of layers that constitute the scale and performed an intensive investigation on the scale adhesion. As a result, it was clarified that, even in a case where no alloy that exhibits an anchoring effect is contained, when the scale has a layer structure including wustite, magnetite, and optional hematite (that is, a layer structure composed of wustite, magnetite, and hematite or a layer structure composed of wustite and magnetite) in order from the base steel sheet side, and the thickness of hematite and magnetite, which are brittle layers on the surface layer side of the scale, is below a certain fraction in the total thickness of the scale, the scale adhesion is enhanced. This mechanism is assumed as follows.

First, scale exfoliation occurs in the following two stages.

(1) During the coiling of the hot rolled steel sheet, during uncoiling in the finishing step, or during processing, cracks occur in the surface layer due to strain that is applied to the scale surface layer, propagate in the scale thickness direction, and reach the interface between the scale and the base metal (base steel sheet).

(2) The cracks propagate to the interface between the scale and the base metal, whereby the scale exfoliates.

Therefore, when hematite or magnetite, which is a brittle layer in the surface layer of the scale, is reduced, the occurrence of surface layer cracks in the stage (1) is prevented, and scale exfoliation is suppressed.

In the related art, studies were made regarding the formation of magnetite on the steel sheet side in the case of enhancing the scale adhesion. However, in the case of adjusting the manufacturing method in order to improve the characteristics of the steel sheet, there are cases where it is difficult to form magnetite on the steel sheet side. In the steal sheet according to the present embodiment, the scale adhesion improves even in a case where wustite is formed on the steel sheet side.

In addition, in the steel sheet according to the present embodiment, the thickness of the scale on the steel sheet surface layer and the thickness of hematite, and magnetite that are included in the scale layer structure are controlled.

As a result of intensive studies, the present inventors found that, in a case where $(h+m)/s<0.20$ is satisfied, the scale adhesion becomes favorable, and the scale has excellent surface properties. $(h+m)/s<0.15$ is preferable, and $(h+m)/s<0.10$ is more preferable. When $(h+m)/s$ becomes 0.20 or more, hematite or magnetite, which is a brittle layer, exfoliates during hot rolling, in the finishing step, or the like, and the surface properties of the steel sheet deteriorate or the scale is likely to exfoliate due to processing.

The scale thickness s is preferably 35.0 μm or less and more preferably 30.0 μm or less. When the scale thickness s is, larger than 35.0 μm, strain that is applied to the scale surface layer during processing becomes great, and the scale is likely to exfoliate due to processing. The scale thickness s is preferably as smaller as possible and may be set to 25.0 μm or less, 21.0 μm or less, 18.0 μm or less, or 16.0 μm or less. It is not necessary to determine the lower limit of the scale thickness s, and the lower limit of the scale thickness s may be set to 1.0 μm, 3.0 μm or 5.0 μm.

Hematite is the outermost layer of the steel sheet and the most brittle in the compositions that constitute the scale. Therefore, $h \leq m/4$ is set. Here, hematite is a thin phase and is not observed in some cases. Therefore, the thickness of hematite may be zero ($h=0$). In a case where hematite is not observed, magnetite becomes the outermost layer. In order to improve the scale adhesion, magnetite is preferably present, and the thickness m of magnetite is preferably set to 0.1 μm or more. The thickness m of magnetite may be set to 0.5 μm or more, 0.8 μm or more, or 1.0 μm or more as necessary.

A method for obtaining the thickness s of the scale, the thickness h of hematite, and the thickness m of magnetite is as described below.

The thickness s of the scale is measured by collecting a sample from the hot rolled steel sheet such that a cross section having the normal line in the sheet width direction (hereinafter, referred to as the L cross section) can be observed, embedding the sample in, a resin, then, photographing the sample, with an optical microscope at a magnification set to, for example, 1000 times and observing the obtained optical microscopic image. In the optical microscopic image, three or more visual fields (here, the thickness s of the scale is measured at one place in each visual field) are observed, the obtained measurement results from the individual visual fields are arithmetically averaged, and the arithmetic average value is regarded as the scale thickness.

The composition of the scale is measured by X-ray diffraction. The cross-sectional structure of the scale is determined from the specific result of the composition by X-ray diffraction and a scanning electron microscopic image of the L cross section. As the scale, ordinarily, wustite (FeO), magnetite ($Fe_3O_4$), and hematite ($Fe_2O_3$) are present. Among them, hematite is usually formed to be thin in the outermost layer of the scale, but can be sufficiently distinguished from other scales by observing the scanning electron microscopic image. In addition, wustite and magnetite can be, distinguished from each other by the difference in contrast in the scanning electron microscopic image. Therefore, how each of wustite, magnetite, and hematite is distributed in the L cross section can be determined by distinguishing the distribution region of each scale in the scanning electron microscopic image and then specifying the composition of each scale by X-ray diffraction. The thickness of magnetite and hematite can be obtained by observing three or more visual fields (here, the thickness h of hematite and the thickness m of magnetite are measured at one place in each visual field) in the scanning electron microscopic image in which the distribution of each scale has been confirmed as described above and arithmetically averaging the measurement results from the individual visual fields. Here, there are cases where hematite is too thin and is thus not observed in the scanning electron microscopic image even when the presence of hematite is confirmed by X-ray diffraction. At that time, the thickness of hematite is regarded as zero (μm).

The sheet thickness of the steel sheet according to the present embodiment is not limited, but is preferably 1.2 mm to 6.0 mm in the case of assuming application to automobile members.

3. Manufacturing Method

Next, a preferred method for manufacturing the steel sheet according to the present embodiment will be described.

The present inventors found that itis effective to control the conditions for hot rolling to coiling in order to obtain the above-described scale layer structure. In addition, the present inventors clarified that the thickness fractions of hematite, magnetite, and wustite that are included in the scale layer structure during hot rolling vary depending on the scale growth rate and the oxygen concentration at the time of the hot rolling, and a preferred scale layer structure can be achieved by controlling the finish rolling temperature, the rolling reduction in the final stand, and the conditions for cooling or coiling after the hot rolling and by covering the surface of the steel sheet with a water film under predetermined conditions during the hot rolling.

Specifically, it was found that the steel sheet according to the present embodiment can be manufactured by a manufacturing method including the following steps.

(I) A heating step of heating a slab having a chemical composition in which C: 0.010% to 0.200%, Si: 0% to 0.30%, Mn: 0.10% to 3.00%, Al: 0.010% to 3.000%, P: 0.100% or less, S: 0.030% or less, N: 0.0100% or less, O: 0.0100% or less, Cu: 0% to 0.10%, Cr: 0% to 0.10%, Ni: 0% to 0.10%. Ti: 0% to 0.30%, Nb: 0% to 0.300%, Mg: 0% to 0.0100%, Ca: 0% to 0.0100%, REM: 0% to 0.1000%, B: 0% to 0.0100%, Mo: 0% to 100%, V: 0% to 0.50%, W: 0% to 0.50% are contained by mass %, the total of the Cu content, the Cr content, and the Ni content is 0.10% or less, and the remainder is Fe and impurities, (II) a hot rolling step of hot rolling the heated slab in a manner that the finish rolling temperature is 850'C or higher and the rolling reduction in the final stage (final stand) of the finish rolling is 5.0% or less to obtain a hot rolled steel sheet, and (III) a coiling step of, after the end of finish rolling, cooling the hot rolled steel sheet to a temperature range of 300° C. or lower at an average cooling rate of faster than 10.0° C./s and coiling the hot rolled steel sheet in the temperature range.

Here, the hot rolling step includes rough rolling and finish rolling, and, during the finish rolling, water is sprayed to the hot rolled steel sheet so as to satisfy the following formula (3) and (5) using a finish rolling apparatus including a plurality of stands and inter-stand sprays that are provided between the plurality of stands and spray the water toward the hot rolled steel sheet.

$$K' \geq 96 \quad (3)$$

Here, K' in the formula (3) is represented by the following formula (4).

$$K' = \Sigma((FT_n - 850) \times S_n) \quad (4)$$

$FT_n$ is the temperature in a unit of ° C. of the hot rolled steel sheet at the $n^{th}$ stand among the plurality of stands of the finish rolling apparatus, and $S_n$ is the amount of water sprayed per time in a unit of $m^3$/min at the time of spraying water toward the steel sheet using the inter-stand spray between the $n-1^{th}$ stand and the $n^{th}$ stand of the finish rolling apparatus. In the present embodiment, the maximum rolling width of the stand (corresponding to the absolute maximum value of the sheet width of the hot rolled steel sheet that can be rolled) is assumed to be 1.5 n to 2.0 m.

$$F > 1 - \{(1/n \times \Sigma FT_n) - 850\}/250 \quad (5)$$

Here, F in the formula (5) indicates the proportion of a time during which the surface of the steel sheet is covered with a water film in the total time taken from the beginning to the completion of the finish rolling, excluding a time during which the steel sheet is in contact with a roll.

Hereinafter, each step will be described.

A manufacturing step preceding the heating step is not particularly limited. That is, the slab may be prepared by melting with a blast furnace, an electric furnace, or the like, subsequently, a variety of secondary smelting, and then casting by a method such as ordinary continuous casting, casting by an ingot, method, or thin slab casting. Scrap may be used as a raw material.

<Heating Step>

The cast slab is heated. In this heating step, the slab is preferably heated to a temperature of 1100° C. or higher and 1300° C. or lower and then retained for 30 minutes or longer. When the heating temperature is lower than 1100° C., there are cases where it is not possible to perform finish rolling at 850° C. or higher in the subsequent hot rolling step, which is not preferable. In a case where the slab contains Ti or Nb, the slab is preferably heated to a temperature of 1200° C. or higher and 1300° C. or lower and then retained for 30 minutes or longer. When the heating temperature is lower than 1200° C., Ti or Nb, which is a precipitation element, is not sufficiently dissolved. In this case, sufficient precipitation strengthening cannot be obtained during the subsequent hot rolling Ti or Nb remains as a coarse carbide and there are cases where the formability deteriorates, which is not preferable. Therefore, in a case where Ti or Nb is contained, the heating temperature of the slab is preferably set to 1200° C. or higher.

On the other hand, when the heating temperature is higher than 1300° C., the amount of scale generated increases, and the yield decreases. Therefore, the heating temperature is preferably set to 1300° C. or lower. In addition, in order to suppress an excessive scale loss, the retention time is preferably set to 10 hours or shorter and more preferably set to five hours or shorter.

In the case of continuous casting, the cast slab may be hot-rolled after being once cooled to a low temperature and then heated again. However, in a case where the cast slab is within the above-described temperature range, the cast slab may be hot-rolled as it is after being cast without being cooled to a low temperature.

<Hot Rolling Step>

Hot rolling includes rough rolling, descaling between the rough rolling and finish rolling, and the finish rolling. In addition, in the finish rolling, water is sprayed to the hot rolled steel sheet with at least one of the inter-stand sprays provided between the plurality of stands.

The heated slab is first rough-rolled to obtain a rough rolled sheet.

In the rough rolling, the conditions therefor are not particularly limited as long as the slab is made into a desired dimensional shape. The thickness of the rough rolled sheet affects the amount of the temperature lowered from the tip to the tail of the hot rolled steel sheet during the beginning of the rolling to the end of the rolling in the finish rolling step and is thus preferably determined in consideration of such a fact.

On the obtained rough rolled sheet, descaling is performed as necessary, and then finish rolling is performed. In this finish rolling, multi-pass finish rolling is performed using a finish rolling apparatus including a plurality of stands and inter-stand sprays provided between the plurality of stands. In the present embodiment, the finish rolling is performed within a temperature range of 1200° C. to 850° C. under conditions that satisfy the following formula (3) and (5).

When the finish rolling temperature is lower than 850° there are cases where a predetermined layer structure is not formed.

$$K' \geq 96 \quad (3)$$

K' in the formula (3) is represented by the following formula (4).

$$K' = \Sigma((FT_n - 850) \times S_n) \quad (4)$$

Here, $FT_n$ is the steel sheet temperature (° C.) at the $n^{th}$ stand during the finish rolling, and $S_n$ is the amount of water sprayed per time ($m^3$/min) at the time of spraying water in a spray form toward the steel sheet between the $n-1^{th}$ stand and the $n^{th}$ stand. ($S_1$ is the amount of water sprayed immediately before the steel sheet is put into the first stand stand for finish rolling)

K' is a parameter of manufacturing conditions regarding scale growth. K' is a value that indicates the effect of suppressing the formation of magnetite and hematite, and, when a larger amount of water is sprayed to the steel sheet at a higher temperature, K' becomes higher. When the K' becomes higher, the formation of hematite and magnetite becomes more difficult.

Based on the mechanism of the formation of hematite and magnetite, it is conceivable that the original parameter of manufacturing conditions that indicates the suppression of scale growth is the integral of the product of "a parameter regarding the temperature" and "a parameter regarding the amount of water sprayed" over the temperature range in which the finish rolling is performed. This is derived from a way of thinking that the formation of hematite, and magnetite is suppressed by spraying a larger amount of water at a higher temperature.

The present inventors studied the use of the parameter K' (formula (4)), which corresponds to the summation of values obtained by dividing the original parameter for individual rolls, in order to make the parameter simpler when controlling the manufacturing conditions and found that scale growth can be controlled using, the parameter K'.)

It is conceivable that the parameter K' may be dissociated from the original parameter depending on the number of stands in a finish rolling mill, the distance between rolls, or the sheet threading speed. However, the present inventors have confirmed that scale growth can be controlled using the parameter K' as long as the number of finish rolling stands is five to eight, the distance between rolls is 4500 mm to 7000 mm, and the sheet threading speed (the speed of the steel sheet after passing the final stand) is within a range of 400 mpm to 900 mpm.

$$F>1-\{(1/n\times\Sigma FT_n)-850\}/250 \quad (5)$$

F indicates the proportion of a time (z seconds) during which the surface of the steel sheet is covered with a water film in the total time (x-y seconds) obtained by excluding a time (y seconds) during which the steel sheet is in contact with a roll from a time (x seconds) taken from the beginning to the completion of the finish rolling. That is, F is represented by z/(x-y).

When the surface of the steel sheet comes into contact with the atmosphere during the finish rolling, the growth of hematite and magnetite is accelerated, but the water film that covers the surface of the steel sheet is capable of suppressing the growth of hematite and magnetite. Therefore, the time during which the surface of the steel sheet is covered with the water film is preferably as long as possible. As the rolling temperature becomes lower, the time during which the surface of the steel sheet is covered with the water film needs to be longer. This is assumed to be because a low rolling temperature suppresses the diffusion of Fe into the scale and thus hematite and magnetite relatively grow as long as oxygen is sufficiently present on the surface of the steel sheet.

The proportion of the time during which the surface of the steel sheet is covered with the water film can be obtained by observing the surface of the steel sheet between the stands with a camera or the like.

In addition, the value of F needs to be managed at least on the upper surface side of the steel sheet. The reason therefor is that, in wheels, lower arms, and the like of automobiles to which the steel sheet according to the present embodiment is mainly applied, it is usual for the upper surface side of rolling to become the surfaces of pressed products, and improvement in the scale adhesion on the upper surface side of rolling is particularly required. In addition, ordinarily, the steel sheet is cooled in a manner that the cooling conditions become the same on the upper surface side and the lower surface side of the steel sheet during cooling. Therefore, when cooling on the upper surface side satisfies the above-described requirement, the above-described preferable scale layer structure is formed at least on the upper surface side, and, frequently, the preferable scale layer structure is also formed on the lower surface side.

As the method for covering the surface of the steel sheet with the water film, a method of spraying water in a spray form between rolls or the like is an exemplary example. In addition, the time during which the surface of the steel sheet is covered with the water film can be controlled by investigating in advance times necessary to cover the surface of the steel sheet with the water film depending on spraying positions and the amounts of water with respect to the size or sheet threading speed of the steel sheet assumed and cooling the steel sheet under conditions determined based on the results.

The rolling reduction in the final stand of finish rolling is ordinary 10.0% or larger; however, in the method for manufacturing the steel sheet according to the present embodiment, it is preferable to perform light reduction in the final stand. Specifically, the rolling reduction in the final stand of the finish rolling is preferably 5.0% or smaller. When the rolling reduction in the final stand is larger than 5.0%, the thickness of hematite and magnetite become large or the external appearance deteriorates. This is assumed to be because the crushing of the scale on the surface layer by rolling facilitates the progress of subsequent oxidation.

<Coiling Step>

The hot rolled steel sheet after the finish rolling is cooled and coiled. After the end of the finish rolling, the obtained hot rolled steel sheet begins to be cooled, is cooled to a temperature range of 300° C. or lower at an average cooling rate of 10.0° C./s or faster, and is coiled within that temperature range.

In the steel sheet according to the present embodiment, the surface properties are controlled not by the control of the base structure but by the improvement of the adhesion of the scale. Therefore, the conditions of the cooling step are not particularly limited as long as the steel sheet is cooled to a temperature range of 300° C. or lower at an average cooling rate of 10.0° C./s or faster after the end of the finish rolling. In a ease where the average cooling rate is slower than 10.0° C./s, the fraction of hematite and magnetite increases, which is not preferable. The upper limit of the cooling rate does not need to be limited and may be set to 150.0° C./s from the viewpoint of manufacturing.

In a case where the coiling temperature (cooling stop temperature) is higher than 300° C., the fraction of magnetite in the scale increases or the layer structure of the scale changes, which is not preferable. Therefore, the coiling temperature is set to 300° C. or lower.

On the hot rolled steel sheet, skin pass rolling may be performed after the cooling as necessary. Skin pass rolling is effective for the prevention of stretcher strain that is generated during process forming or shape correction.

EXAMPLES

Hereinafter, the steel sheet according to the present invention will be described more specifically with reference to examples. Here, conditions in examples to be described below are exemplary conditions adopted to confirm the feasibility and effects of the present invention, and the present invention is not limited to these exemplary conditions. The present invention is capable of adopting, a variety of conditions within the scope of the gist of the present invention as long as the objective of the present invention is achieved.

Steels (A to MO having chemical components shown in Table 1 were cast, after the casting, slabs were heated to a temperature range of 1200° C. to 1300° C. as they were or after being once cooled CO room temperature and then retained for 60 minutes.

After that, the slabs were rough-rolled at temperatures of 1100° C. or higher to produce rough-rolled sheets.

After that, the rough-rolled sheets were finish-rolled under individual conditions shown in Table 2 using one of the following three types of finish rolling mills.

Rolling mill A: The number of stands: seven, the distance between rolls: 5500 mm, and the sheet threading speed 700 mpm Rolling mill B: The number of stands: six, the distance between rolls: 5500 min, and the sheet threading speed: 600 mpm Rolling mill C: The number of stands even, the distance between rolls: 6000 mm, and the sheet threading speed: 700 mpm After the end of the finish rolling, cooling and coiling were performed under conditions shown in the table to produce hot rolled steel sheets (Nos. 1 to 41).

TABLE 1

| | Chemical composition (unit: mass %, remainder: Fe and impurities) | | | | | | | | | | | | | | |
|---|---|---|---|---|---|---|---|---|---|---|---|---|---|---|---|
| Steel | C | Si | Mn | Al | P | S | N | O | Ti | Nb | Cu | Cr | Ni | Other | Classification |
| A | 0.060 | 0.05 | 2.20 | 0.030 | 0.010 | 0.001 | 0.0020 | 0.0032 | <0.001 | <0.001 | 0.02 | 0.01 | 0.03 | | Invention Steel |
| B | 0.090 | 0.25 | 2.40 | 0.030 | 0.010 | 0.002 | 0.0020 | 0.0031 | <0.001 | <0.001 | 0.02 | 0.01 | 0.03 | | Invention Steel |
| C | 0.070 | 0.19 | 0.65 | 0.050 | 0.010 | 0.001 | 0.0030 | 0.0024 | 0.12 | <0.001 | 0.01 | 0.02 | 0.02 | | Invention Steel |
| D | 0.150 | 0.05 | 2.00 | 1.200 | 0.010 | 0.002 | 0.0030 | 0.0029 | <0.001 | 0.010 | 0.01 | 0.02 | 0.02 | | Invention Steel |
| E | 0.080 | 0.22 | 2.22 | 0.050 | 0.011 | 0.003 | 0.0050 | 0.0028 | 0.11 | 0.020 | 0.01 | 0.00 | 0.01 | | Invention Steel |
| F | 0.110 | 0.27 | 1.80 | 0.030 | 0.011 | 0.001 | 0.0020 | 0.0032 | <0.001 | <0.001 | 0.01 | 0.01 | 0.02 | Mg: 0.0020 | Invention Steel |
| G | 0.060 | 0.29 | 1.95 | 0.030 | 0.011 | 0.001 | 0.0030 | 0.0031 | <0.001 | <0.001 | 0.02 | 0.02 | 0.01 | Ca: 0.0020 | Invention Steel |
| H | 0.070 | 0.05 | 1.60 | 0.020 | 0.012 | 0.001 | 0.0030 | 0.0030 | <0.001 | <0.001 | 0.02 | 0.03 | 0.02 | Mo: 0.01 | Invention Steel |
| I | 0.180 | 0.27 | 2.15 | 0.750 | 0.010 | 0.003 | 0.0030 | 0.0028 | <0.001 | 0.040 | 0.01 | 0.02 | 0.02 | B: 0.0010 | Invention Steel |
| J | 0.060 | 0.15 | 1.88 | 0.030 | 0.010 | 0.001 | 0.0030 | 0.0030 | <0.001 | <0.001 | 0.01 | 0.01 | 0.01 | V: 0.01 | invention Steel |
| K | 0.060 | 0.25 | 0.90 | 0.029 | 0.010 | 0.001 | 0.0030 | 0.0031 | <0.001 | <0.001 | 0.01 | 0.01 | 0.01 | W: 0.01 | Invention Steel |
| L | 0.080 | 0.19 | 1.80 | 0.030 | 0.011 | 0.002 | 0.0030 | 0.0030 | <0.001 | <0.001 | 0.02 | 0.01 | 0.01 | REM: 0.0010 | Invention Steel |
| M | 0.090 | 0.90 | 2.20 | 0.100 | 0.010 | 0.002 | 0.0020 | 0.0030 | <0.001 | <0.001 | 0.01 | 0.02 | 0.03 | | Comparative Steel |

TABLE 2

| No. | Steel type | Sheet thickness (mm) | $FT_1$ (° C.) | $FT_2$ (° C.) | $FT_3$ (° C.) | $FT_4$ (° C.) | $FT_5$ (° C.) | $FT_6$ (° C.) | $FT_7$ (° C.) | $S_1$ ($m^3$/min) | $S_2$ ($m^3$/min) | $S_3$ ($m^3$/min) | $S_4$ ($m^3$/min) | $S_5$ ($m^3$/min) | $S_6$ ($m^3$/min) | $S_7$ ($m^3$/min) | Rolling reduction in final stand (%) | Rolling mill |
|---|---|---|---|---|---|---|---|---|---|---|---|---|---|---|---|---|---|---|
| 1 | A | 2.8 | 1031 | 1019 | 1008 | 994 | 989 | 985 | 979 | 0.0 | 0.2 | 0.2 | 0.8 | 0.2 | 0.0 | 0.0 | 5.7 | A |
| 2 | A | 2.8 | 981 | 952 | 930 | 912 | 900 | 894 | 862 | 0.0 | 1.5 | 1.8 | 1.8 | 1.8 | 0.0 | 0.0 | 13.1 | A |
| 3 | A | 2.8 | 1002 | 995 | 983 | 975 | 957 | 951 | 942 | 0.0 | 1.5 | 1.8 | 0.0 | 0.0 | 0.0 | 0.0 | 5.0 | A |
| 4 | A | 2.8 | 1001 | 1002 | 980 | 964 | 958 | 959 | 955 | 0.0 | 1.2 | 1.8 | 2.0 | 2.0 | 0.0 | 1.2 | 4.7 | A |
| 5 | A | 2.8 | 950 | 934 | 914 | 895 | 877 | 864 | 855 | 0.0 | 1.0 | 1.0 | 0.4 | 0.0 | 0.0 | 0.0 | 4.8 | A |
| 6 | A | 2.8 | 1025 | 1000 | 975 | 950 | 923 | 894 | 870 | 0.0 | 0.2 | 0.2 | 0.0 | 0.0 | 0.0 | 1.2 | 4.9 | A |
| 7 | A | 2.8 | 937 | 912 | 889 | 872 | 858 | 842 | 835 | 0.4 | 0.2 | 0.2 | 1.8 | 1.8 | 1.5 | 1.2 | 4.8 | A |
| 8 | A | 2.8 | 1098 | 1078 | 1065 | 1040 | 1025 | 1008 | 985 | 0.0 | 0.2 | 0.4 | 0.0 | 1.5 | 0.0 | 0.0 | 4.2 | A |
| 9 | A | 2.0 | 1002 | 1001 | 978 | 971 | 974 | 943 | 945 | 0.0 | 0.0 | 1.2 | 2.0 | 2.0 | 1.5 | 1.2 | 5.0 | A |
| 10 | A | 2.4 | 1096 | 1059 | 1014 | 983 | 941 | 894 | 856 | 0.0 | 1.4 | 1.8 | 0.0 | 0.0 | 0.0 | 0.0 | 4.7 | C |
| 11 | B | 2.8 | 1058 | 1046 | 1016 | 1004 | 975 | 956 | 946 | 0.0 | 0.0 | 1.8 | 0.0 | 1.5 | 0.0 | 0.0 | 4.7 | C |
| 12 | B | 2.8 | 1043 | 1030 | 1008 | 1001 | 982 | 959 | 944 | 0.0 | 0.0 | 1.8 | 1.8 | 0.0 | 1.5 | 1.2 | 4.8 | A |
| 13 | B | 3.2 | 1025 | 1018 | 1003 | 1003 | 991 | 974 | 966 | 0.4 | 1.4 | 1.8 | 1.8 | 1.8 | 0.4 | 0.4 | 4.7 | A |
| 14 | B | 3.2 | 992 | 983 | 965 | 962 | 947 | 928 | 917 | 0.0 | 0.0 | 1.8 | 1.8 | 1.8 | 1.5 | 1.2 | 4.6 | A |
| 15 | B | 3.6 | 1004 | 994 | 977 | 973 | 958 | 939 | — | 0.4 | 1.4 | 1.8 | 1.8 | 1.8 | 0.4 | — | 4.8 | B |
| 16 | B | 4.5 | 1020 | 930 | 925 | 920 | 915 | 900 | 893 | 0.4 | 1.5 | 1.8 | 1.8 | 1.8 | 1.5 | 1.5 | 4.2 | C |
| 17 | C | 2.8 | 1013 | 986 | 979 | 978 | 975 | 964 | 957 | 0.0 | 0.4 | 0.0 | 0.0 | 0.0 | 0.0 | 0.0 | 4.7 | A |
| 18 | C | 2.8 | 1018 | 999 | 985 | 954 | 938 | 913 | 895 | 0.0 | 0.0 | 1.8 | 1.8 | 0.0 | 1.5 | 1.2 | 4.7 | C |
| 19 | C | 2.9 | 1053 | 1024 | 986 | 963 | 929 | 889 | 859 | 0.0 | 1.4 | 1.8 | 1.8 | 0.0 | 0.0 | 0.4 | 4.7 | C |
| 20 | C | 2.9 | 1018 | 1012 | 999 | 999 | 988 | 973 | 966 | 0.0 | 0.0 | 1.2 | 1.8 | 1.5 | 0.4 | 2.4 | 4.6 | A |
| 21 | C | 2.9 | 1081 | 1049 | 1010 | 984 | 947 | 906 | 873 | 0.0 | 1.4 | 1.8 | 1.8 | 1.8 | 0.4 | 0.4 | 4.8 | A |
| 22 | C | 2.9 | 1016 | 997 | 970 | 958 | 934 | 905 | 885 | 0.4 | 1.5 | 0.0 | 0.0 | 1.5 | 2.4 | 2.4 | 4.7 | A |
| 23 | C | 2.9 | 1089 | 1053 | 1009 | 980 | 939 | 893 | 856 | 0.0 | 0.4 | 1.8 | 0.0 | 0.0 | 0.0 | 0.0 | 4.8 | A |

TABLE 2-continued

| No. | Steel type | Sheet thickness (mm) | $FT_1$ (° C.) | $FT_2$ (° C.) | $FT_3$ (° C.) | $FT_4$ (° C.) | $FT_5$ (° C.) | $FT_6$ (° C.) | $FT_7$ (° C.) | $S_1$ ($m^3$/min) | $S_2$ ($m^3$/min) | $S_3$ ($m^3$/min) | $S_4$ ($m^3$/min) | $S_5$ ($m^3$/min) | $S_6$ ($m^3$/min) | $S_7$ ($m^3$/min) | Rolling reduction in final stand (%) | Rolling mill |
|---|---|---|---|---|---|---|---|---|---|---|---|---|---|---|---|---|---|---|
| 24 | C | 2.9 | 1076 | 1057 | 1030 | 1018 | 994 | 965 | 945 | 0.4 | 1.4 | 1.8 | 1.8 | 1.8 | 0.4 | 0.4 | 4.5 | A |
| 25 | C | 2.9 | 1043 | 1035 | 1020 | 1018 | 1005 | 988 | — | 0.0 | 1.4 | 1.8 | 1.8 | 1.8 | 0.4 | — | 4.7 | B |
| 26 | D | 2.9 | 1079 | 1049 | 1011 | 987 | 951 | 911 | 880 | 0.4 | 0.4 | 0.4 | 0.4 | 0.0 | 0.0 | 0.0 | 4.6 | A |
| 27 | D | 2.9 | 1088 | 1068 | 1040 | 1026 | 1001 | 971 | 950 | 0.0 | 1.4 | 0.0 | 1.8 | 1.8 | 0.4 | 0.4 | 4.7 | A |
| 28 | D | 2.9 | 1023 | 1002 | 973 | 958 | 931 | 900 | 878 | 0.4 | 1.4 | 1.8 | 0.0 | 1.8 | 0.4 | 0.4 | 4.7 | A |
| 29 | D | 4.0 | 998 | 983 | 960 | 952 | 932 | 907 | 891 | 0.0 | 1.4 | 1.8 | 1.8 | 0.0 | 0.4 | 0.4 | 4.8 | A |
| 30 | D | 4.0 | 1038 | 1023 | 1001 | 992 | 972 | 948 | 932 | 0.4 | 1.4 | 1.8 | 1.8 | 1.8 | 0.0 | 0.4 | 4.7 | A |
| 31 | D | 6.0 | 1017 | 994 | 963 | 947 | 919 | 886 | 862 | 0.0 | 1.5 | 1.8 | 0.0 | 0.0 | 0.0 | 1.2 | 4.2 | A |
| 32 | D | 6.0 | 1033 | 1009 | 976 | 958 | 929 | 894 | 869 | 0.4 | 1.4 | 1.8 | 1.8 | 1.8 | 0.4 | 0.4 | 4.2 | A |
| 33 | E | 2.9 | 1090 | 1058 | 1019 | 993 | 956 | 915 | 882 | 0.0 | 0.4 | 0.0 | 0.0 | 0.0 | 0.0 | 0.0 | 4.6 | A |
| 34 | F | 2.9 | 1085 | 1052 | 1010 | 983 | 944 | 901 | 866 | 0.4 | 0.0 | 0.0 | 0.0 | 1.5 | 0.4 | 2.4 | 4.6 | C |
| 35 | G | 2.9 | 982 | 980 | 970 | 975 | 968 | 956 | 953 | 0.0 | 1.2 | 1.8 | 1.8 | 0.0 | 1.5 | 2.4 | 4.7 | A |
| 36 | H | 2.9 | 997 | 975 | 963 | 928 | 950 | 891 | 855 | 0.0 | 1.2 | 0.0 | 1.8 | 0.0 | 1.5 | 2.4 | 4.8 | A |
| 37 | I | 2.9 | 1044 | 1023 | 994 | 979 | 953 | 922 | 900 | 0.0 | 1.2 | 1.8 | 1.8 | 1.5 | 1.5 | 1.2 | 4.8 | A |
| 38 | J | 2.9 | 1054 | 1039 | 1017 | 1008 | 988 | 964 | 948 | 0.0 | 0.0 | 1.8 | 1.8 | 0.0 | 0.4 | 0.4 | 4.7 | A |
| 39 | K | 2.9 | 1007 | 999 | 982 | 980 | 967 | 948 | 939 | 0.0 | 1.2 | 0.0 | 1.8 | 0.0 | 0.4 | 0.4 | 4.8 | A |
| 40 | L | 2.9 | 990 | 977 | 955 | 948 | 930 | 906 | 892 | 0.4 | 1.4 | 1.8 | 1.8 | 1.8 | 0.4 | 0.4 | 4.7 | A |
| 41 | M | 2.9 | 1023 | 1005 | 979 | 967 | 944 | 916 | 897 | 0.4 | 1.4 | 1.8 | 1.8 | 1.8 | 0.4 | 0.4 | 4.8 | A |

[Observation and Measurement of Scale Layer]

A sample for observing an L cross section was collected from the obtained hot rolled steel sheet, and the thickness of the scale was measured from an optical microscopic image of the L cross section of the sample.

In addition, for the collected sample, the composition of the scale was measured by X-ray diffraction, and a cross section of the scale was observed with a canning electron microscope, thereby specifying the cross sectional structure of the scale and measuring the thicknesses of wustite, hematite, and magnetite.

Detailed conditions for the measurement are the same as the conditions described in the embodiment of the invention. The results are shown in Table 3.

In Table 3, "OK" in the "scale layer structure" column indicates a case where a layer structure composed of wustite, magnetite, and optional hematite in order, from the steel sheet side is present, and "NG" indicates a case where such a layer structure is not present.

In addition, for the obtained hot rolled steel sheet, the external appearance and the scale adhesion were evaluated.

[External Appearance Evaluation]

For the external appearance evaluation, the surface after the hot rolling was visually observed, a case where there was no dimple, exfoliation, pattern, or the like and the external appearance was favorable was evaluated as OK, and a case where there was dimple, exfoliation, pattern, or the like and the external appearance was poor was evaluated as NG.

[Scale Adhesion Evaluation]

The scale adhesion was evaluated by performing a 90 degree bending test.

Specifically, an L-direction strip-shaped test piece (30 mm×200 mm×overall thickness) was collected from the hot rolled steel sheet, a 90 degree bending test was performed on the obtained test piece under a condition of a bend radius of 25 mm, the scale exfoliation status in a 40 mm portion in the longitudinal direction on the inner peripheral side of the bent portion in the test piece obtained after the test was observed, and the scale adhesion was evaluated into grades 1 to 4 based on the observation result.

The specific evaluation criteria are as follows.

Grade 1: A case where no scale exfoliation occurred.

Grade 2: A case where no scale exfoliation occurred, but wrinkles were formed on the surface layer.

Grade 3: A case where minor scale exfoliation occurred in the evaluation test, but it seemed that exfoliation would not occur in practical processing (a case where the area of the scale exfoliation portion was smaller than 10%).

Grade 4: A case where the area of the scale exfoliation portion was 10% or larger in the evaluation test and scale exfoliation that seemed to cause a practical problem occurred.

The area of the exfoliation portion was obtained by photographing a subject area and performing image processing based on the contrast between the exfoliation portion and a steady portion.

The results are shown in Table 3.

TABLE 3

| No. | Average cooling rate (° C./s) | Coiling temperature (° C.) | F | 1 − {(1/n × ΣFTn) − 850}/250 | K' | Scale layer structure | s (μm) | m (μm) | h (μm) | (m + h)/s | m/4 | External appearance | Scale adhesion | Note |
|---|---|---|---|---|---|---|---|---|---|---|---|---|---|---|
| 1 | 50.0 | 100 | 0.86 | 0.40 | 208 | OK | 10.5 | 2.5 | 1.0 | 0.33 | 0.63 | NG | 4 | Comparative Example |
| 2 | 20.0 | 100 | 0.86 | 0.73 | 499 | OK | 9.0 | 2.3 | 1.0 | 0.37 | 0.58 | NG | 4 | Comparative Example |
| 3 | 5.0 | 100 | 0.61 | 0.51 | 457 | OK | 25.0 | 8.0 | 2.0 | 0.40 | 2.00 | NG | 4 | Comparative Example |
| 4 | 50.0 | 600 | 0.92 | 0.50 | 987 | NG | 20.0 | — | — | — | — | NG | 1 | Comparative Example |

TABLE 3-continued

| No. | Average cooling rate (° C./s) | Coiling temperature (° C.) | F | 1 − {(1/n × ΣFTn) − 850}/250 | K' | Scale layer structure | s (μm) | m (μm) | h (μm) | (m + h)/s | m/4 | External appearance | Scale adhesion | Note |
|---|---|---|---|---|---|---|---|---|---|---|---|---|---|---|
| 5 | 20.0 | 100 | 0.76 | 0.81 | 166 | OK | 10.0 | 2.4 | 0.5 | 0.29 | 0.60 | OK | 4 | Comparative Example |
| 6 | 50.0 | 100 | 0.67 | 0.61 | 79 | OK | 10.0 | 3.2 | 0.5 | 0.37 | 0.80 | OK | 4 | Comparative Example |
| 7 | 50.0 | 100 | 0.67 | 0.89 | 79 | OK | 10.0 | 3.0 | 0.0 | 0.37 | 0.75 | OK | 4 | Comparative Example |
| 8 | 15.0 | 100 | 0.71 | 0.23 | 394 | OK | 32.1 | 5.2 | 1.0 | 0.19 | 1.30 | OK | 2 | Invention Example |
| 9 | 20.0 | 100 | 0.62 | 0.51 | 897 | OK | 12.0 | 1.8 | 0.0 | 0.15 | 0.45 | OK | 1 | Invention Example |
| 10 | 50.0 | 100 | 0.61 | 0.49 | 588 | OK | 14.0 | 2.1 | 0.0 | 0.15 | 0.53 | OK | 1 | Invention Example |
| 11 | 50.0 | 100 | 0.33 | 0.40 | 485 | OK | 14.0 | 4.6 | 0.9 | 0.39 | 1.15 | NG | 4 | Comparative Example |
| 12 | 20.0 | 100 | 0.52 | 0.42 | 831 | OK | 10.0 | 1.2 | 0.2 | 0.14 | 0.30 | OK | 3 | Invention Example |
| 13 | 20.0 | 100 | 1.00 | 0.41 | 1205 | OK | 16.0 | 2.4 | 0.0 | 0.15 | 0.60 | OK | 2 | Invention Example |
| 14 | 20.0 | 100 | 0.62 | 0.58 | 779 | OK | 10.0 | 1.5 | 0.0 | 0.15 | 0.38 | OK | 1 | Invention Example |
| 15 | 10.0 | 100 | 1.00 | 0.50 | 944 | OK | 12.0 | 1.8 | 0.0 | 0.15 | 0.45 | OK | 1 | Invention Example |
| 16 | 50.0 | 100 | 1.00 | 0.68 | 706 | OK | 14.0 | 2.1 | 0.0 | 0.15 | 0.53 | OK | 2 | Invention Example |
| 17 | 50.0 | 100 | 0.37 | 0.48 | 54 | OK | 15.0 | 5.0 | 1.0 | 0.40 | 1.25 | NG | 4 | Comparative Example |
| 18 | 5.0 | 100 | 0.52 | 0.57 | 581 | OK | 20.0 | 4.1 | 0.8 | 0.25 | 1.03 | NG | 4 | Comparative Example |
| 19 | 30.0 | 100 | 0.82 | 0.57 | 696 | OK | 14.0 | 2.1 | 0.0 | 0.15 | 0.53 | OK | 2 | Invention Example |
| 20 | 50.0 | 100 | 0.62 | 0.43 | 986 | OK | 12.0 | 1.7 | 0.0 | 0.14 | 0.43 | OK | 2 | Invention Example |
| 21 | 50.0 | 100 | 1.00 | 0.49 | 1001 | OK | 9.0 | 1.0 | 0.0 | 0.11 | 0.25 | OK | 1 | Invention Example |
| 22 | 50.0 | 100 | 0.61 | 0.59 | 628 | OK | 9.0 | 1.6 | 0.0 | 0.18 | 0.40 | OK | 1 | Invention Example |
| 23 | 50.0 | 100 | 0.61 | 0.50 | 368 | OK | 8.0 | 1.4 | 0.0 | 0.18 | 0.35 | OK | 1 | Invention Example |
| 24 | 50.0 | 100 | 1.00 | 0.35 | 1349 | OK | 14.0 | 2.0 | 0.0 | 0.14 | 0.50 | OK | 1 | Invention Example |
| 25 | 50.0 | 100 | 1.00 | 0.33 | 1202 | OK | 17.0 | 2.0 | 0.4 | 0.14 | 0.50 | OK | 2 | Invention Example |
| 26 | 20.0 | 450 | 0.76 | 0.48 | 290 | NG | 12.0 | — | — | — | — | NG | 3 | Comparative Example |
| 27 | 30.0 | 100 | 0.77 | 0.32 | 982 | OK | 14.0 | 2.0 | 0.4 | 0.17 | 0.50 | OK | 1 | Invention Example |
| 28 | 30.0 | 100 | 0.85 | 0.59 | 680 | OK | 12.0 | 1.7 | 0.3 | 0.17 | 0.43 | OK | 1 | Invention Example |
| 29 | 30.0 | 100 | 0.90 | 0.62 | 607 | OK | 16.0 | 2.0 | 0.4 | 0.15 | 0.50 | OK | 1 | Invention Example |
| 30 | 30.0 | 100 | 0.92 | 0.45 | 1098 | OK | 9.0 | 1.2 | 0.2 | 0.16 | 0.30 | OK | 1 | Invention Example |
| 31 | 30.0 | 100 | 0.67 | 0.64 | 435 | OK | 10.0 | 1.5 | 0.3 | 0.18 | 0.38 | OK | 1 | Invention Example |
| 32 | 30.0 | 100 | 1.00 | 0.59 | 884 | OK | 10.0 | 1.3 | 0.3 | 0.16 | 0.33 | OK | 1 | Invention Example |
| 33 | 10.0 | 100 | 0.37 | 0.45 | 83 | OK | 10.0 | 3.0 | 0.6 | 0.36 | 0.75 | NG | 4 | Comparative Example |
| 34 | 10.0 | 100 | 0.24 | 0.49 | 294 | OK | 12.0 | 3.0 | 0.6 | 0.30 | 0.75 | NG | 4 | Comparative Example |
| 35 | 50.0 | 100 | 0.90 | 0.52 | 1003 | OK | 13.0 | 1.8 | 0.4 | 0.17 | 0.45 | OK | 1 | Invention Example |
| 36 | 30.0 | 100 | 0.67 | 0.65 | 364 | OK | 9.0 | 1.4 | 0.3 | 0.18 | 0.34 | OK | 1 | Invention Example |
| 37 | 20.0 | 100 | 1.00 | 0.51 | 1022 | OK | 10.0 | 1.2 | 0.2 | 0.14 | 0.30 | OK | 1 | Invention Example |
| 38 | 20.0 | 100 | 0.52 | 0.39 | 668 | OK | 14.0 | 2.2 | 0.4 | 0.19 | 0.55 | OK | 2 | Invention Example |
| 39 | 30.0 | 100 | 0.67 | 0.50 | 487 | OK | 12.0 | 1.8 | 0.4 | 0.18 | 0.45 | OK | 1 | Invention Example |
| 40 | 30.0 | 100 | 1.00 | 0.63 | 782 | OK | 8.0 | 1.2 | 0.2 | 0.18 | 0.30 | OK | 1 | Invention Example |
| 41 | 30.0 | 100 | 1.00 | 0.55 | 943 | OK | 15.0 | 2.3 | 0.5 | 0.18 | 0.56 | NG | 1 | Comparative Example |

As shown in Table 1 to Table 3, in the examples (invention examples) in which the conditions of the present invention were satisfied, the scale adhesion was excellent and the surface properties were preferable in all cases. On the other hand, in the comparative example in which at least one of the conditions of the present invention was not satisfied, any or both of the external appearance and the scale adhesion were poor.

INDUSTRIAL APPLICABILITY

According to the present invention, it is possible to provide a hot rolled steel sheet having excellent surface properties and excellent scale adhesion. Since the scale adhesion is excellent and thus scale exfoliation is suppressed during hot rolling, during coiling, or in a finishing step, the hot rolled steel sheet of, the present invention is excellent in terms of the surface properties (surface external appearance) as hot rolled steel sheets. In addition, since the scale adhesion is excellent and thus it is also possible to suppress the exfoliation of the scale at the time of processing this hot rolled steel sheet into, components or the like, the hot rolled steel sheet is also excellent in terms of the external appearance after processing.

BRIEF DESCRIPTION OF THE REFERENCE SYMBOLS

1 Hot rolled steel sheet
10 Base steel sheet
20 Scale
21 Wustite
22 Magnetite
23 Hematite

The invention claimed is:

1. A hot rolled steel sheet comprising:
a base steel sheet; and
a scale formed on a surface of the base steel sheet,
wherein a chemical composition of the base steel sheet contains, by mass %,
C: 0.010% to 0.200%,
Si: 0% to 0.30%,
Mn: 0.10% to 3.00%,
Al: 0.010% to 3.000%,
P: 0.100% or less,
S: 0.030% or less,
N: 0.0100% or less,
O: 0.0100% or less,
Cu: 0% to 0.10%,
Cr: 0% to 0.10%,
Ni: 0% to 0.10%,
Ti: 0% to 0.30%,
Nb: 0% to 0.300%,
Mg: 0% to 0.0100%,
Ca: 0% to 0.0100%,
REM: 0% to 0.1000%,
B: 0% to 0.0100%,
Mo: 0% to 1.00%,
V: 0% to 0.50%,
W: 0% to 0.50%, and
a remainder: Fe and impurities,
a total of a Cu content, a Cr content, and a Ni content of the base steel sheet is 0.10% or less by mass %,
the scale has a layer structure consisting of wustite, magnetite, and hematite in order from the base steel sheet side or a layer structure consisting of the wustite and the magnetite in order from the base steel sheet side, and
when a thickness of the scale is represented by s, a thickness of the hematite is represented by h, and a thickness of the magnetite is represented by m, the s, the h, and the m satisfy formula (1) and formula (2), $$(h+m)/s<0.20 \quad \text{Formula (1)}$$

$$h\leq m/4 \quad \text{Formula (2).}$$

2. The hot rolled steel sheet according to claim 1,
wherein the thickness of the scale is 35.0 μm or less.

3. The hot-rolled steel sheet according to claim 2,
wherein the thickness of the scale is 30.0 μm or less.

4. The hot-rolled steel sheet according to claim 1,
wherein a thickness of the hot rolled steel sheet is 1.0 mm to 6.0 mm.

5. The hot-rolled steel sheet according to claim 1,
wherein the chemical composition of the base steel sheet contains, by mass %, one or more selected from the group of:
Ti: 0.01% to 0.30%,
Nb: 0.010% to 0.300%,
Mg: 0.0003% to 0.0100%,
Ca: 0.0003% to 0.0100%,
REM: 0.0003% to 0.1000%,
B: 0.0005% to 0.0100%,
Mo: 0.005% to 1.00%,
V: 0.005% to 0.50%, and
W: 0.005% to 0.50%.

6. A hot rolled steel sheet comprising:
a base steel sheet; and
a scale formed on a surface of the base steel sheet,
wherein a chemical composition of the base steel sheet contains, by mass %,
C: 0.010% to 0.200%,
Si: 0% to 0.30%,
Mn: 0.10% to 3.00%,
Al: 0.010% to 3.000%,
P: 0.100% or less,
S: 0.030% or less,
N: 0.0100% or less,
O: 0.0100% or less,
Cu: 0% to 0.10%,
Cr: 0% to 0.10%,
Ni: 0% to 0.10%,
Ti: 0% to 0.30%,
Nb: 0% to 0.300%,
Mg: 0% to 0.0100%,
Ca: 0% to 0.0100%,
REM: 0% to 0.1000%,
B: 0% to 0.0100%,
Mo: 0% to 1.00%,
V: 0% to 0.50%,
W: 0% to 0.50%, and
a remainder: Fe and impurities,
a total of a Cu content, a Cr content, and a Ni content of the base steel sheet is 0.10% or less by mass %,
the scale has a layer structure comprising wustite, magnetite, and hematite in order from the base steel sheet side or a layer structure comprising wustite and the magnetite in order from the base steel sheet side, and
when a thickness of the scale is represented by s, a thickness of the hematite is represented by h, and a thickness of the magnetite is represented by m, the s, the h, and the m satisfy formula (1) and formula (2), $$(h+m)/s<0.20 \quad \text{Formula(1)}$$

$$h\leq m/4 \quad \text{Formula(2).}$$

* * * * *